US009879499B2

(12) United States Patent
Artherholt et al.

(10) Patent No.: US 9,879,499 B2
(45) **Date of Patent: *Jan. 30, 2018**

(54) ATMOSPHERE TO PRESSURE BALL DROP APPARATUS

(71) Applicant: OIL STATES ENERGY SERVICES, L.L.C., Houston, TX (US)

(72) Inventors: Danny Artherholt, Asher, OK (US); Bob McGuire, Meridian, OK (US); Jeremy Gardner, Del City, OK (US); Dennis Artherholt, Oklahoma City, OK (US)

(73) Assignee: OIL STATES ENERGY SERVICES, L.L.C., Houston, TX (US)

( * ) Notice: Subject to any disclaimer, the term of this patent is extended or adjusted under 35 U.S.C. 154(b) by 36 days.

This patent is subject to a terminal disclaimer.

(21) Appl. No.: 15/242,029

(22) Filed: Aug. 19, 2016

(65) Prior Publication Data

US 2016/0356112 A1 Dec. 8, 2016

Related U.S. Application Data

(63) Continuation-in-part of application No. 14/329,234, filed on Jul. 11, 2014, now Pat. No. 9,447,652.
(Continued)

(51) Int. Cl.
*E21B 43/26* (2006.01)
*E21B 33/068* (2006.01)
(Continued)

(52) U.S. Cl.
CPC ..... *E21B 33/068* (2013.01); *E21B 33/05* (2013.01); *E21B 34/14* (2013.01); *E21B 43/26* (2013.01)

(58) Field of Classification Search
CPC ..... E21B 33/068; E21B 43/26; E21B 34/14; E21B 33/05; E21B 43/14; E21B 34/063; E21B 43/12; E21B 43/267
See application file for complete search history.

(56) References Cited

U.S. PATENT DOCUMENTS 3,322,140 A 5/1967 Scott
3,911,724 A 10/1975 Grove et al.
(Continued)

OTHER PUBLICATIONS

Patent Cooperation Treaty; International Search Report and Written Opinion dated Nov. 14, 2014, United States.

*Primary Examiner* — Zakiya W Bates
(74) *Attorney, Agent, or Firm* — Morgan, Lewis & Bockius LLP

(57) ABSTRACT

An improved ball drop apparatus including an atmosphere-to-pressure frac ball injection chamber. A ball is first inserted into the atmosphere-to-pressure ball injection chamber from a ball feeding apparatus. The ball is then pushed into a pressure equalization section through a first seal pack. In a preferred embodiment, the pressure equalization section is connected to a pressure equalization apparatus and also to the wellbore through a second seal pack. Once the ball is injected into the pressure equalization section, the pressure equalization apparatus applies pressure, thereby causing the pressure of the pressure equalization section to increase until it reaches close to wellbore pressure. Once the pressures of the pressure equalization section and the wellbore are close, the atmosphere-to-pressure frac ball injection chamber and the frac ball are pushed through the second seal pack and into the wellbore, where the frac ball can be pumped downhole. The atmosphere-to-pressure ball injection chamber is then retracted into the pressure equalization section. The pressure equalization section can then be returned to atmospheric or close to atmospheric pressure by the pressure
(Continued)

equalization apparatus. The ball injection chamber is then returned to a ball loading position where it may again be loaded by a ball feeding apparatus.

29 Claims, 10 Drawing Sheets

Related U.S. Application Data

(60) Provisional application No. 61/847,346, filed on Jul. 17, 2013.

(51) Int. Cl.
*E21B 34/14* (2006.01)
*E21B 33/05* (2006.01)

(56) References Cited

U.S. PATENT DOCUMENTS

| | | | |
|---|---|---|---|
| 4,132,243 | A | 1/1979 | Kuus |
| 2012/0152525 | A1 | 6/2012 | McGuire |
| 2012/0211219 | A1 | 8/2012 | McGuire et al. |
| 2012/0279717 | A1 | 11/2012 | Young et al. |
| 2014/0360720 | A1 | 12/2014 | Corbeil |

ATMOSPHERE TO PRESSURE BALL DROP APPARATUS

RELATED APPLICATIONS

This application is a continuation-in-part of U.S. patent application Ser. No. 14/329,234, filed on Jul. 11, 2014, which claimed the benefit of U.S. Provisional Patent Application Ser. No. 61/847,346 filed on Jul. 17, 2013, both of these applications are herein incorporated by reference in their entirety.

BACKGROUND

1. Field of the Invention

The invention relates to ball drop injection assemblies for use at a wellsite during hydraulic fracturing operations.

2. Description of the Related Art

Frac ball injection to control fluid flow in a well has seen use in fracturing operations for some time. Frac balls are often inserted into a wellbore to control fluid flow between different sections of a well. The balls are pumped downhole along with well stimulation fluid. It has generally been determined to be time consuming and potentially hazardous for on-site personnel to manually handle frac balls around the wellbore as equipment sometimes extend high into the air and a number of high pressure lines can surround the well to pump stimulation or other fluids into the well. The industry has sought ways to limit the manual interaction required by on-site personnel when injecting frac balls at the wellbore. One option that reduces overall injection times and the amount of manual involvement by on-site personnel involves the use of frac ball dropping assemblies.

Frac ball dropping assemblies have seen greater use in fracturing operations more recently given the efficiencies that can be achieved with frac ball injection, and the additional safety factor they provide to on-site personnel. In fracturing operations it is useful to drop frac balls of varying sizes into the wellbore, where they can be pumped downhole. The frac balls can be used to control fluid flow beneath the surface in a well. This can be useful when, for example, it is more efficient to stimulate and produce from different stages of a well at a particular time in the overall fracturing operation. Over time hydraulic fracturing has seen greater use of ball drop assemblies to stimulate well production, in part because of the time savings and in part because of the reduced manual interaction required of on-site personnel.

Ball drop assemblies can require frac balls of sequentially larger diameter to be stored in a frac ball stack above the wellhead. The balls in this stack are often stored in water or other fluids and often require some degree of temperature control. Recently, dissolvable frac balls have seen increased use, dissolvable ball designs hold up better in dry and non-pressurized storage rather than in fluid and at wellbore pressure. It would be desirable to provide a dry and atmospheric pressure storage option for frac balls just prior to well injection. It would also be desirable to eliminate the need for temperature control of the ball drop apparatus.

In addition, ball drop assemblies have seen issues and often cannot function with balls of similar or substantially similar sizes coming one after another without substantially increasing the height of the ball drop assembly and adding additional structure to accommodate the configuration. Thus, it would also be desirable to provide a system that can handle the injection of substantially similar ball sizes in a sequential manner without the need to increase the height of the ball drop assembly.

SUMMARY OF THE INVENTION

The present invention provides a ball drop apparatus that allows for dry frac ball staging and storage just prior to injection while also providing flexibility in the number and size-ordering of the balls to be injected. In a preferred embodiment, an improved ball drop apparatus is provided, which includes a pressure equalization section that connects with a pressure equalization apparatus, and the wellbore through a seal pack. The general sequence of operations starts with a frac ball being inserted from a ball feeding section into an atmosphere-to-pressure ball injection chamber. The atmosphere-to-pressure ball injection chamber is connected to and a part of an injection ram assembly. The atmosphere-to-pressure ball injection chamber and frac ball are then pushed through a first seal pack and into the pressure equalization section by hydraulics connected to the injection ram assembly. In accordance with a preferred embodiment, the pressure equalization apparatus then applies pressure to the pressure equalization section, causing the pressure within the section to increase until it reaches at or near wellbore pressure. Once the pressures are close, the injection chamber and ball are pushed through the second seal pack and into the wellbore. The ball can then be pumped downhole. Following the injection of a ball, the atmosphere-to-pressure ball injection chamber is retracted into the pressure equalization section. The injection chamber can be returned to atmospheric or close to atmospheric pressure by the pressure equalization apparatus connected to the pressure equalization section by a port. In an alternate embodiment, a ball may be pushed into the pressure equalization section, and pressure may be increased only partially, not all the way to wellbore pressure. The ball may then be injected through the seal pack or packs. This embodiment may allow some pressure and/or fluid to bleed back through the pressure equalization section or ball injection chamber after injection but may be preferred for some configurations. In yet another alternate embodiment, pressure may not be equalized at all when the ball reaches the pressure equalization section. The frac ball may then be injected into the wellbore. This embodiment may also allow for pressure and/or fluid to bleed back through the pressure equalization section or ball injection chamber after injection if no pressure equalization section is configured but may be preferred for some wellsites or reduced-cost tool configurations.

This sequence can be carried out over and over again for frac balls of varying sizes or for the sequential injection of equal size or similarly sized frac balls. Dissolvable frac balls can also benefit from this design since they can be stored in a dry environment until they are placed into the frac ball injection chamber to be inserted in the wellbore, thus preserving the integrity of the dissolvable balls prior to injection and consistent results between drops.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 1:
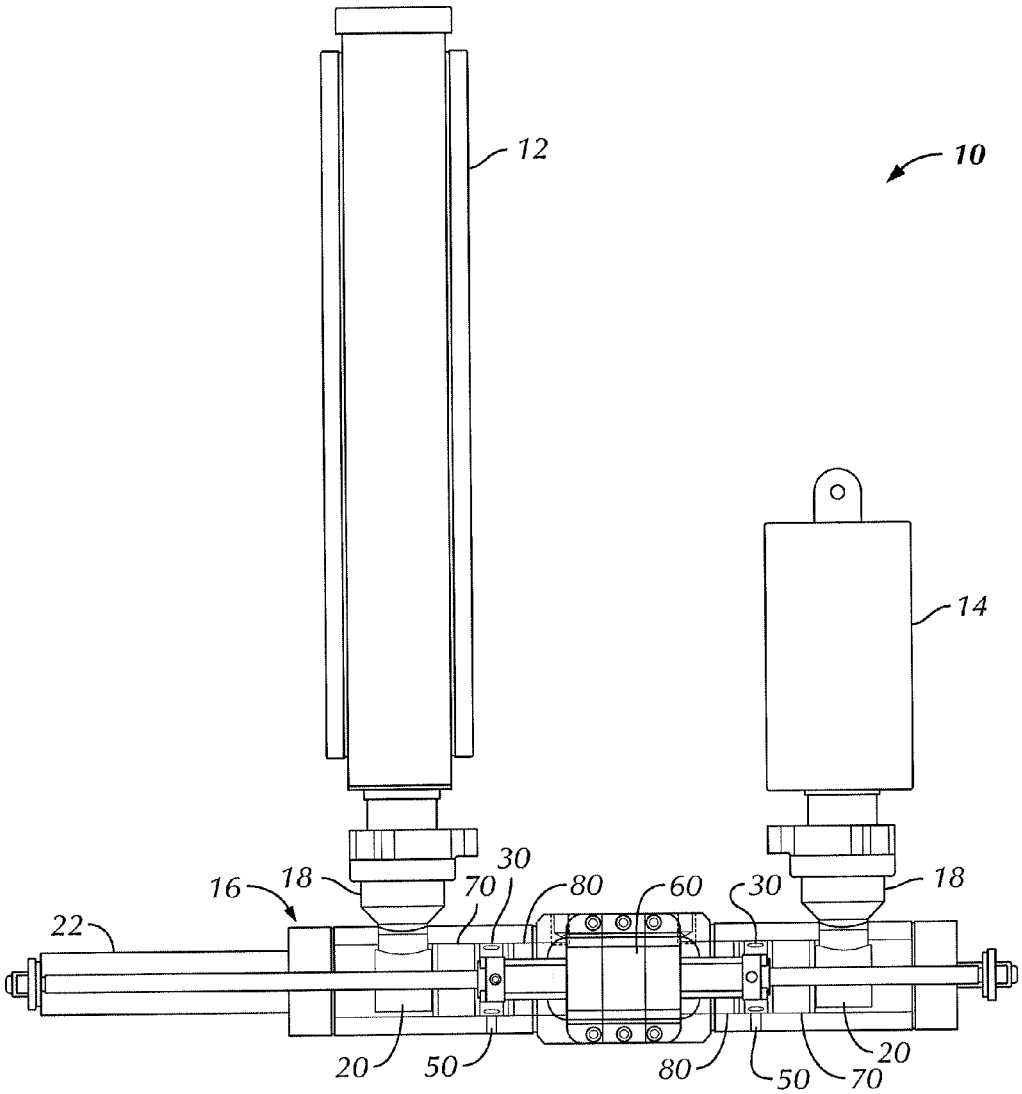
FIG. 1 is a side cross sectional view of an atmosphere-to-pressure ball drop assembly with one ball injection stack and one ball injection stack counterweight.
Figure 2:
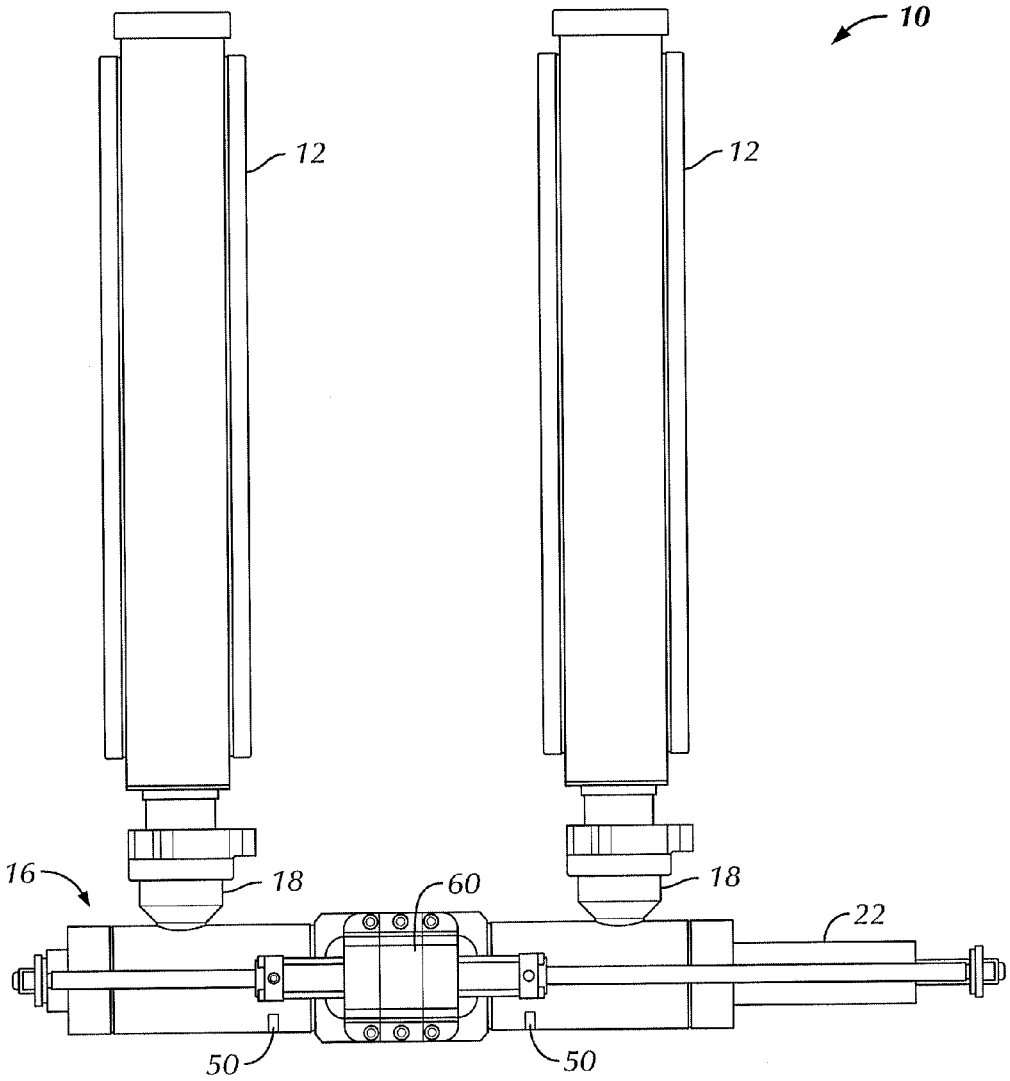
FIG. 2 is a side cross sectional view of an alternate atmosphere-to-pressure ball drop assembly with two ball injection stacks.

Exemplary embodiments are illustrated in referenced Figures of the drawings. It is intended that the embodiments and Figures disclosed herein are to be considered illustrative rather than restrictive. No limitation on the scope of the technology that follows is to be imputed to the examples shown in the drawings and discussed herein.

Referring to FIGS. 1-6, an atmosphere-to-pressure ball drop assembly 10 is shown that allows for fast injection of frac balls of varying sizes and for the sequential injection of equal size or similarly sized frac balls. An additional benefit, especially for dissolvable frac balls, is that the balls can be kept dry and under atmospheric pressure leading up to injection, thus maintaining the integrity of the frac balls and ensuring consistent results between drops. The embodiment illustrated in FIG. 1 includes a single ball drop stack 12 and an optional counterweight 14. The embodiment illustrated in FIG. 2 includes two ball drop stacks 12. The ball drop stack 12 and/or counterweight 14 connect to a main body of the atmosphere-to-pressure ball drop apparatus 16 by ball drop and/or counterweight receivers 18. Various ball drop apparatus stacks or assemblies known in the industry or as may be conceived can be substituted for the ball drop apparatus illustrated in FIGS. 1 and 2. In an embodiment, the atmosphere-to-pressure ball drop assembly 10 additionally includes one or more atmosphere-to-pressure frac ball injection chambers 20, an ball injection ram assembly 22, one or more pressure equalization sections 30, and one or more pressure equalization assemblies (that are preferably hydraulic assemblies), one or more pressure equalization ports 50, and an axial passageway 60 that connects the atmosphere-to-pressure ball drop assembly 10 to the wellbore.

One or more first seal packs 70 separate the atmosphere-to-pressure frac ball injection chamber 20 from the pressure equalization section 30 until the frac ball is to be injected. A second seal pack 80 further separates the pressure equalization section 30 from the axial passageway 60 connected to the wellbore. In an embodiment, the pressure equalization apparatus (not shown) can be spaced apart from the pressure equalization section 30 and connected by a fluid carrying line (not shown) that connects at pressure equalization port 50.

The ball drop receiver 18 can connect to a variety of ball feeding mechanisms, such as a controlled aperture ball drop as disclosed in U.S. Patent Application Publication No. 2012/0279717, a horizontal frac ball injector as disclosed in U.S. Patent Application Publication No. 2012/0211219, or other ball feeding mechanisms as known in the industry, or as may be conceived.

Figure 3:
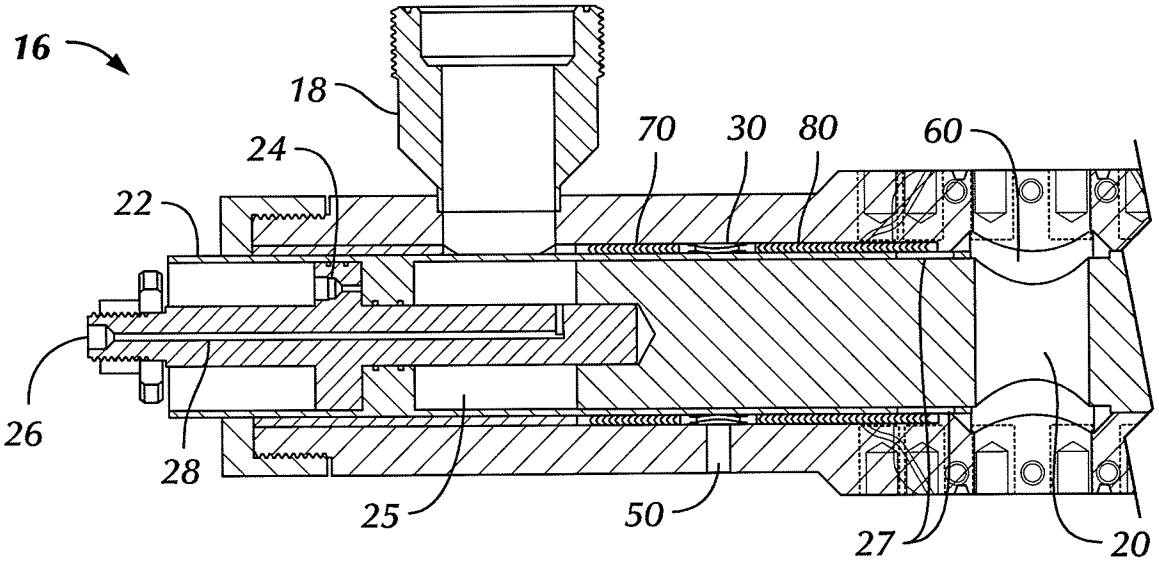
FIG. 3 is an enlarged side cross sectional view of one side of an atmosphere-to-pressure ball drop apparatus, shown with the ball injection stack removed.
Figure 4:
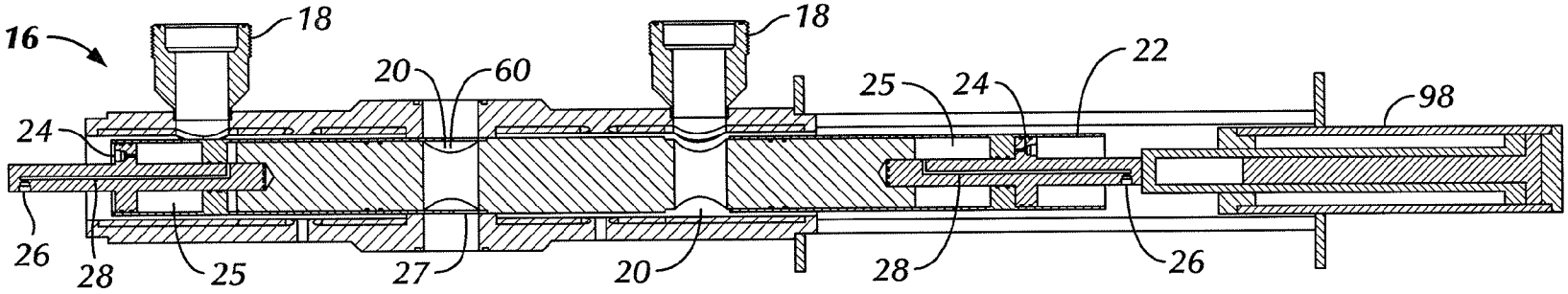
FIG. 4 shows an alternative embodiment of a side cross sectional view of an atmosphere-to-pressure ball drop apparatus, shown with any ball injection stacks and counterweights removed, and configured with hydraulics mounted on one side of the apparatus.

Referring to FIGS. 3-4, in an embodiment the ball injection ram assembly 22 can optionally be configured to include one or more first ram internal hydraulic pressure ports 24, which can be configured to fill an outer ram cavity 25, the cavity 25 can be formed by a portion of the ram assembly 22. As the outer ram cavity 25 is filled and pressurized, a piston is made to move within cavity 25 and a tubular sleeve 27 is pushed towards axial passageway 60, thereby surrounding or forming a tubular cavity around the frac ball injection chamber 20 and any frac ball or balls contained inside the injection chamber 20. The sleeve can optionally include one or more fluid passageways on the upper and lower portions of the sleeve 27 to allow fluid to pass through the sleeve 27. One or more second hydraulics (not shown) connect to pressure ports 24 and can also connect to ram injection chamber hydraulic pressure ports 26, which can be configured with an internal hydraulic fluid passageway 28 that travels from the outer portion of the ram assembly 22 to the inner portion of the ram assembly 22. The one or more first ram internal hydraulic pressure ports 24 and ram injection chamber ports 26 can be filled with hydraulic fluid by the connected separate second hydraulics to move the ram assembly sleeve 27, the sleeve 27 forming axially spaced rigid tubular sidewalls that open and directly interface with the seal packs as the injection ram assembly 22 is made to move through the main body 16. When the injection chamber 20 contains one or more frac balls, the frac balls are confined within the axially spaced tubular sidewalls forming the sleeve 27. The sleeve 27 interacts with and pushes against the first seal 70 and the second seal 80 as the ram assembly 22 moves towards and away from the axial passageway 60 connected to the wellbore. Optionally, one or more fluid passageways can be placed in the sleeve sidewalls to provide a fluid pathway to relieve pressure between the sidewalls forming the sleeve 27 and the ball injection chamber 20.

Figure 8:
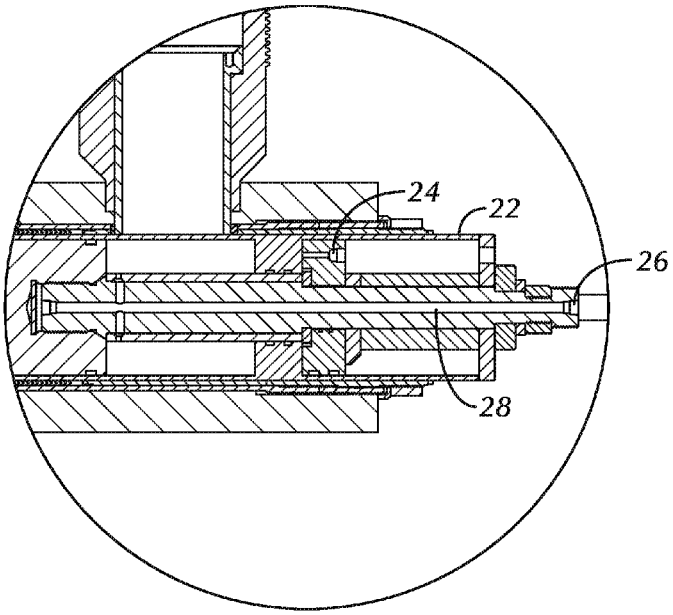
FIG. 8 is an enlarged side cross sectional view of an alternative arrangement of the ram assembly of an atmosphere-to-pressure ball drop apparatus.

As shown in FIGS. 3-4, the portion of ram assembly 22 that includes first ram internal hydraulic pressure ports 24, ram injection chamber ports 26, and internal hydraulic fluid passageway 28 may be formed as a single piece. However, as shown in FIG. 8, this portion of ram assembly 22 may also be formed as multiple separate pieces. For example, the portion of ram assembly 22 that includes first ram internal hydraulic pressure port 24 may be formed separately from the rest of ram assembly 22. Other portions of ram assembly 22 may also be formed as separate pieces. Separating ram assembly 22 into multiple pieces may aid in the assembly and disassembly of this portion of main body 16.

Figure 5:
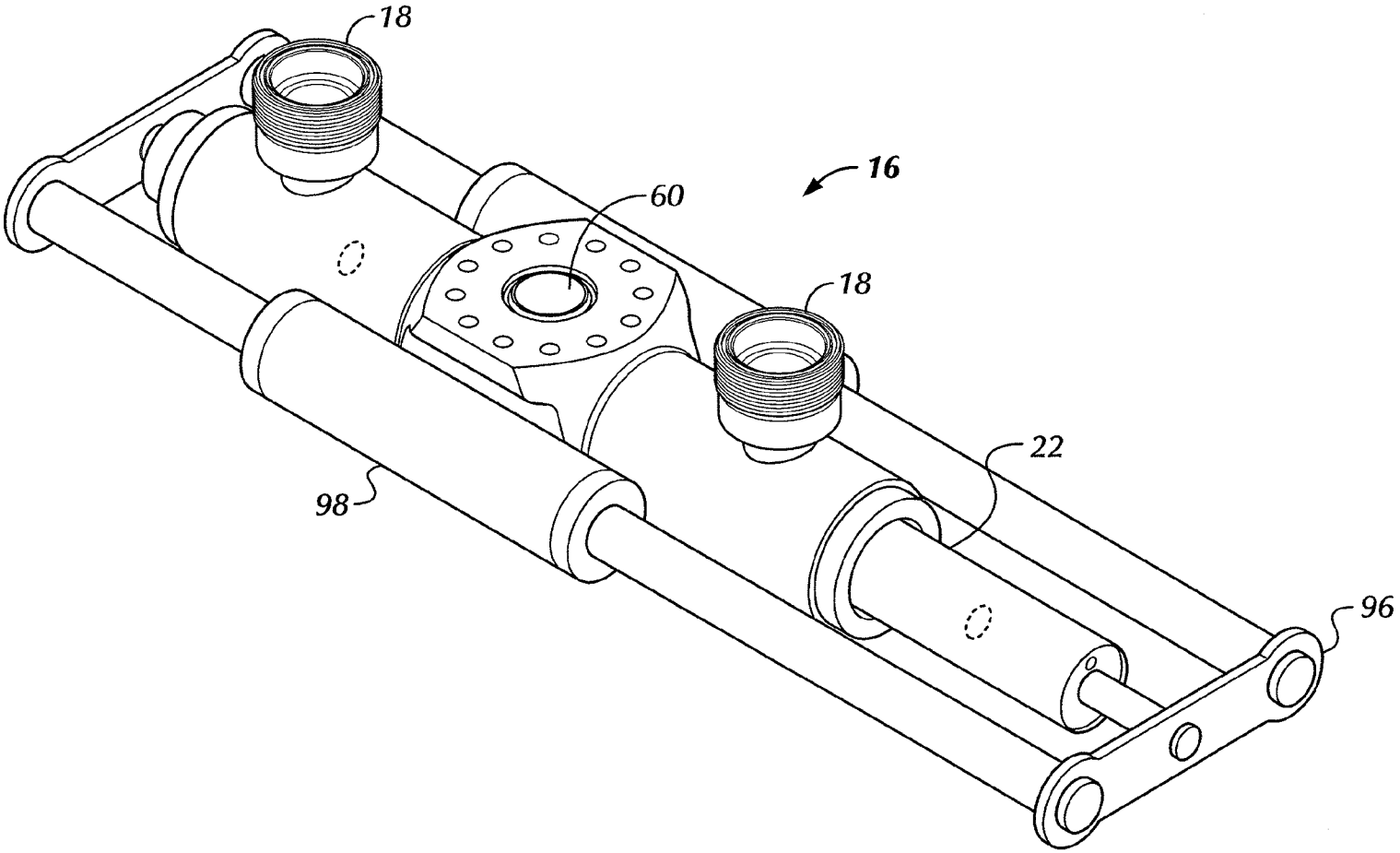
FIG. 5 is an isometric perspective view of an atmosphere-to-pressure ball drop apparatus, shown with any ball injection stacks and counterweights removed.
Figure 6:
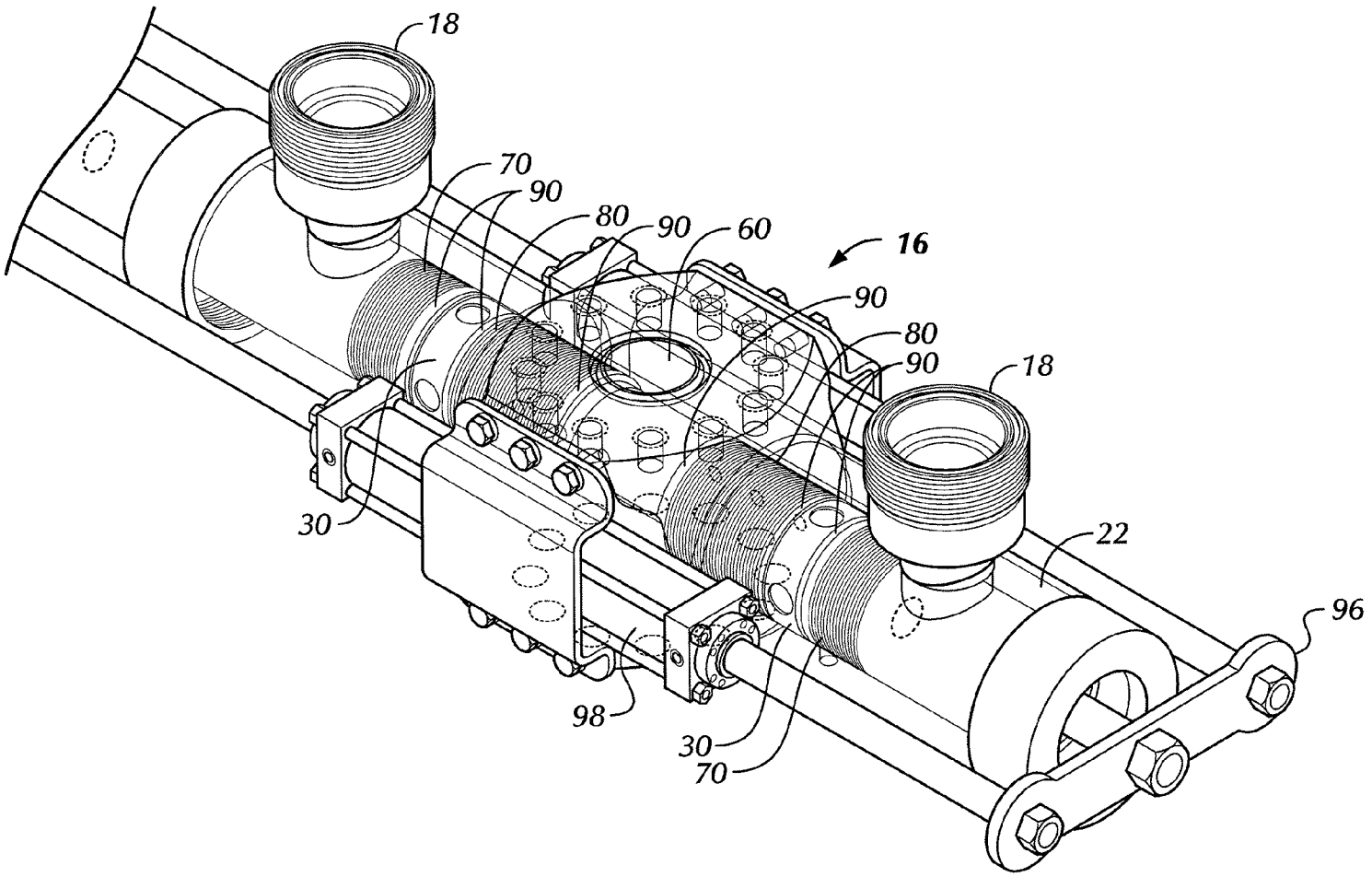
FIG. 6 is an enlarged isometric perspective view of an atmosphere-to-pressure ball drop apparatus, showing the internal seal pack placement of the apparatus.

Referring to FIGS. 5-6, in an embodiment, hydraulics 98 can be mounted to both sides of the atmosphere to pressure ball injection assembly 10, depending on the particular configuration of a tool. One advantage of the centrally mounted hydraulics shown in FIG. 5 is that the ball passageways of the ram assembly 22 are substantially always kept in alignment with axial passageway 60 by the optional hydraulic mounting arms 96. It is also possible to configure alternate hydraulics configurations that may not include hydraulic mounting arms 96, the ram assembly 22 would then require additional structure to maintain the alignment of the ram assembly 22 and injection chamber 20 with the axial passageway 60. The injection chamber 20 needs to be aligned with the ball drop receivers 18 and axial passageway 60 to both receive and eject frac balls from the injection chamber 20 without the balls getting stuck or otherwise displaced.

Figure 7A:
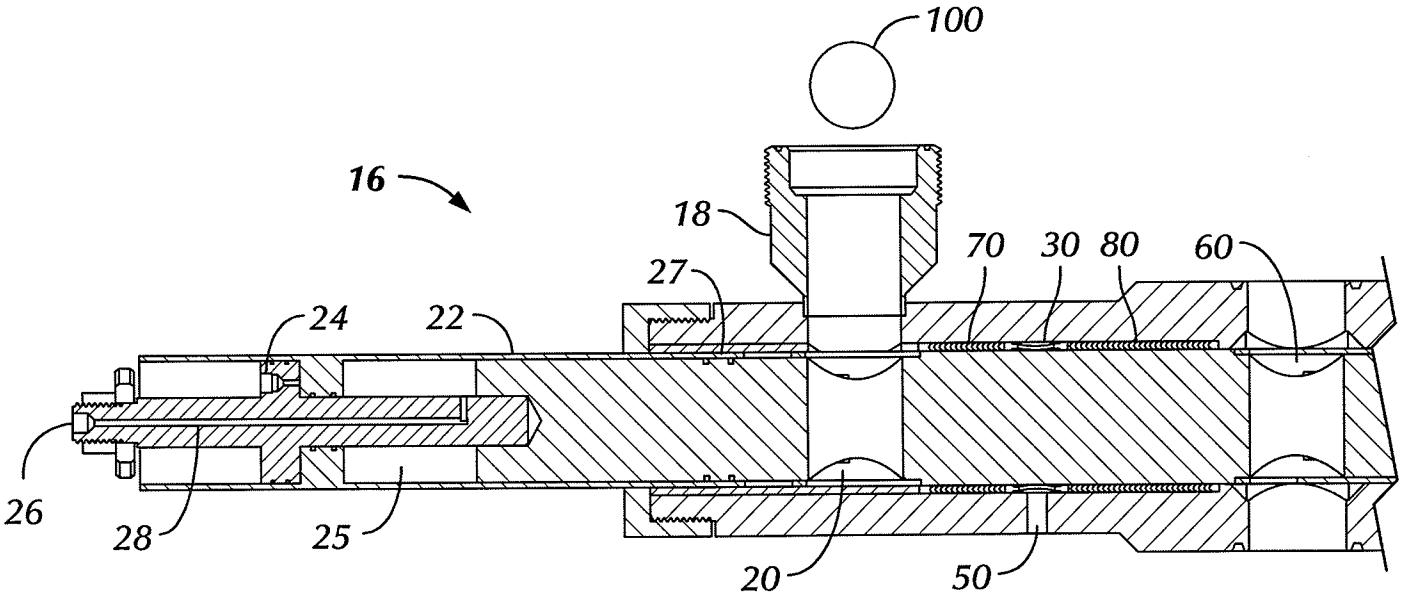
FIG. 7A-7E is an enlarged side cross sectional view of an atmosphere-to-pressure ball drop apparatus showing the various ball placement and injection positions of the apparatus, shown with the ball injection stack removed.
Figure 7B:
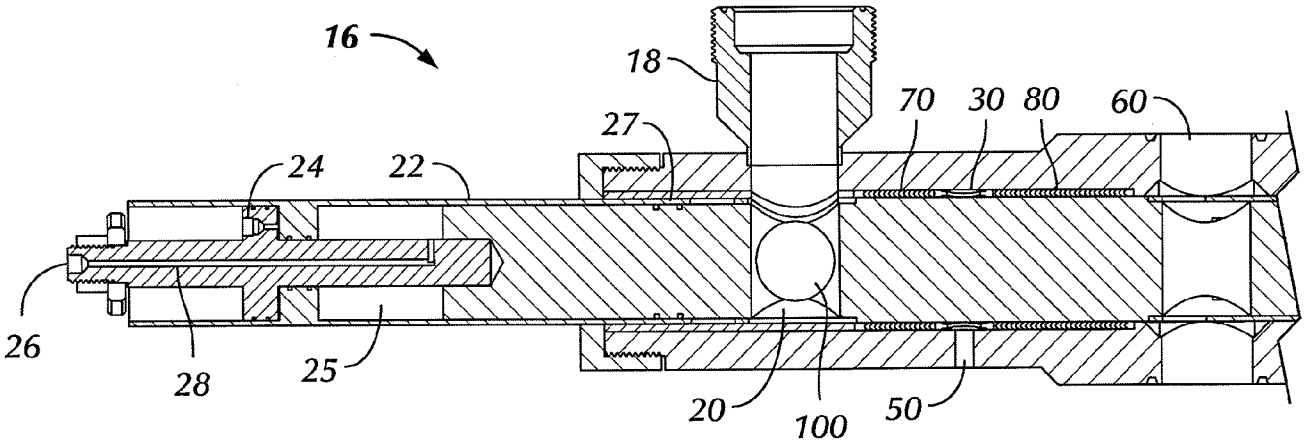
Figure 7C:
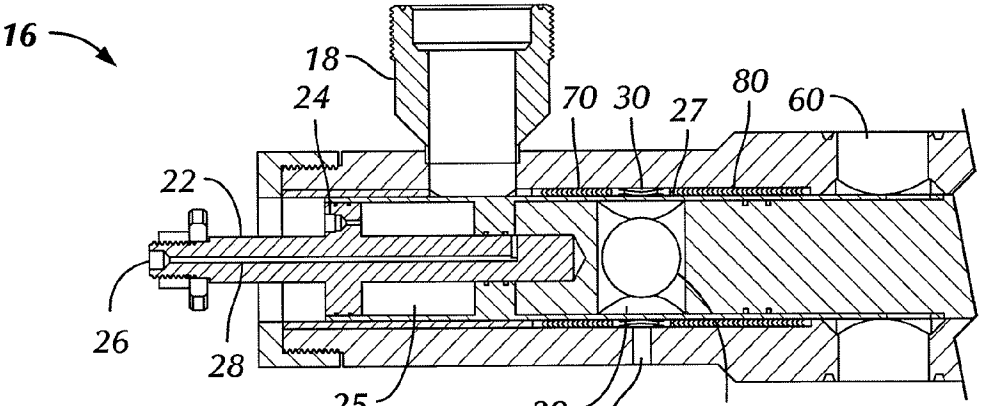
Figure 7D:
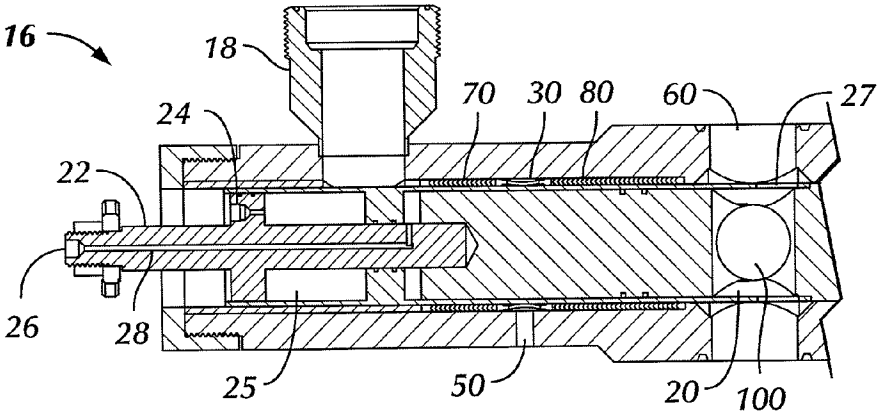
Figure 7E:
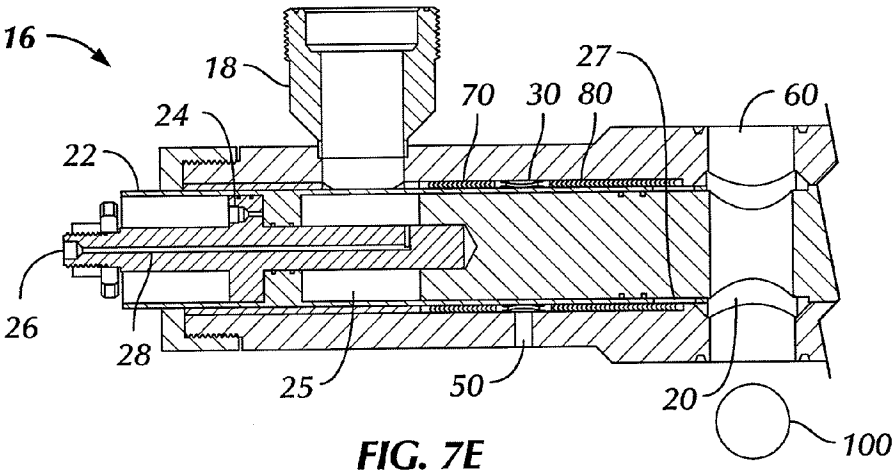

Referring to FIGS. 7A-7E, the general sequence of operations starts, as shown in FIG. 7A, with a frac ball 100, being fed into the atmosphere-to-pressure ball injection chamber 20 from the ball feeding section 18 when sleeve 27 is configured in the open or withdrawn position. The sleeve 27 is then deployed or moved to the closed position, the sleeve 27 deploying around the ball injection chamber 20. Referring to FIG. 7B, the atmosphere-to-pressure ball injection chamber 20 and frac ball 100 are then pushed through the first seal pack 70 into the pressure equalization section 30. Next, in the preferred embodiment, the pressure equalization apparatus connected to the pressure equalization port 50 builds and transfers pressure, causing the pressure within the ball injection chamber 20 situated within the pressure equalization section 30 to increase until at or near wellbore pressure is achieved (or optionally lower than wellbore pressure in the alternative embodiments described). The sleeve 27 remains closed during this time, allowing the optional fluid passageway to transfer fluid from the pressure equalization port 50 to the injection chamber 20. Once the pressures are approximately matched, the injection ram assembly 22 pushes the atmosphere-to-pressure ball injection chamber 20 and ball 100 through the second seal pack 80 and into the axial passageway 60, thus injecting the frac ball 100 into the wellbore. Optionally, the pressure building step can be skipped or the pressure built up in the pressure equalization chamber can fall somewhere under wellbore pressure, the preferred solution depending on the configuration and/or requirements at a particular wellsite. The frac ball 100 can then be pumped downhole along with well stimulation or other fluid being sent downhole or simply dropped into the axial passageway and allowed to flow downhole. Following the injection of a frac ball 100, the ball injection chamber 20 is retracted from the axial passageway 60 into the pressure equalization section 30. The sleeve 27 can then be retracted or moved to the open position or alternatively can be moved to the open position once returned to the ball loading position under the ball feeding section 18. Next, in an embodiment, the pressure equalization section 30 is returned to atmospheric or close to atmospheric pressure by the pressure equalization apparatus (not shown). In another alternate embodiment, the pressure and fluid can simply be bled off to an on-site storage tank or container through pressure equalization port 50.

Referring to FIG. 6, in an embodiment, seal saver rings 90 can be configured adjacent the first seal 70 and the second seal 80, preferably on each side of the second seal 80 and preferably at least on the wellbore facing side of first seal 70. The seal saver rings 90 can be hardened seal material, metal, plastic, or a combination of materials and optionally include a ceramic or other coating. The seal saver rings 90 limit fluid movement and pressure changes between the injection chamber and the cavity the seal is opening to, thereby providing abrasion resistance to the respective seals they are adjacent to. The seal saver rings 90 serve to protect and preserve the integrity and longevity of the seals. In particular, seal saver rings 90 can be configured to interface with varying seal pack types or custom made to interface with a particular seal pack type.

Figure 9:
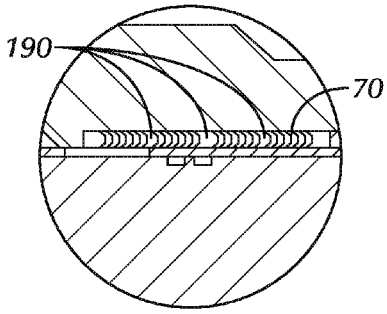
FIG. 9 is an enlarged side cross sectional view of an alternative seal pack assembly arrangement of an atmosphere-to-pressure ball drop apparatus.

As shown in FIG. 9, support rings 190 can be inserted into seal pack 70 and/or seal pack 80. Support rings 190 can be interspersed between subsections of seal pack 70 and/or seal pack 80, and may have male and female ends, as shown in FIG. 9. However, the precise shape, number and location of support rings 190 may vary from the particular configuration shown in FIG. 9. Support rings 190 are intended to increase the longevity of seal pack 70 and/or seal pack 80. Support rings 190 may be formed of a variety of materials, including but not limited to brass, bronzed aluminum, ductile steel, copper beryllium, phenolic materials, or anything that is softer than the material comprising ram assembly sleeve 27.

Figure 10:
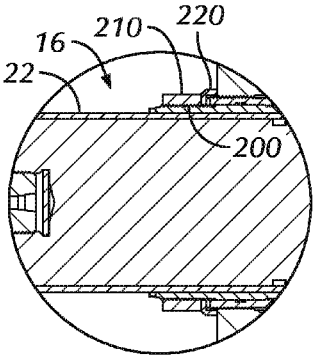
FIG. 10 is an enlarged side cross sectional view of an alternative main body configuration of an atmosphere-to-pressure ball drop apparatus.

Referring to FIG. 10, main body 16 may also include a threaded portion 200 which is threadably engaged by packing stop nut 210. Main body 16 may also include plate 220 which may abut packing stop nut 210 as shown in FIG. 10. This alternate configuration may reduce the forces on sleeve 27 as it transfers forces to other portions of main body 16 as ram assembly 22 moves towards and away from axial passageway 60.

The preferred embodiment of the pressure equalization apparatus (not shown), includes a pressurized piston in a closed system that can be used to add and remove pressure from the pressure equalization section 30. The pressure equalization apparatus can share a common fluid reservoir with the pressure equalization section 30 that can be connected by the fluid carrying line. Optionally, multiple fluid carrying lines can be used. When the piston of the pressure equalization apparatus actuates, it compresses the shared fluid in the common fluid reservoir and increases the pressure both in the pressure equalization apparatus reservoir and in the pressure equalization section 30. The piston can be actuated hydraulically or by other means known in the industry. For frac balls of different sizes the piston movement can vary in the amount of stroke needed to achieve a given pressure. For example, with a larger ball size the pressure equalization section would contain a smaller volume of fluid and the piston would require a shorter stroke to achieve the desired pressure for injection of the ball. Likewise, for a smaller ball size, the pressure equalization section would contain a larger volume of fluid and the piston would require a longer stroke to achieve the desired pressure for injection of the ball. Pressure sensors could optionally be installed on either the pressure equalization section, the pressurized portion of the pressure equalization apparatus, or both. This would help on-site personnel or electronic control systems control the pressure equalization operation of the system. Over time, this system may experience dirty or sandy fluid building up in the well fluid side of the pressure equalization apparatus. In an embodiment a filter and side reservoir of fluid can be connected to this well fluid section to remove any sand or other substrate that could harm the operation of the system.

In an alternate embodiment, the pressure equalization configuration can consist of a pressure bleeding pathway between the axial passageway 60 at wellbore pressure and the pressure equalization section 30 as the means to increase the pressure equalization section 30 to wellbore pressure. In this configuration a valve or other switching means for this line would be employed to control when the pressure equalization section 30 is brought up to wellbore pressure. In this embodiment, bringing the pressure equalization section 30 back to atmospheric pressure would involve bleeding the pressure equalization section 30 to an on-site container or reservoir.

In another alternate embodiment, the atmosphere-to-pressure ball injection chamber 20 and frac ball 100 or multiple frac balls can be pushed through both the first seal pack 70 and the second seal pack 80 without any pressure pre-equalization occurring. Further, in this embodiment, when the injection chamber is retracted from the wellbore, pressure can be bled off through the pressure equalization section to an onsite container before the injection chamber is returned to the ball loading position.

In an embodiment, the injection ram assembly 22 can be actuated by hydraulic means, an electric motor, a mechanical motor, or by other means known in the industry. Further, though the injection chamber described is formed by the injection ram assembly, the apparatus can also be configured with a separate injection ram and injection chamber housing. Additionally, a screw-drive, multiple screw-drives, or other similar assemblies can be substituted for the hydraulics to cause the injection chamber to move between the various described positions.

In an embodiment, multiple frac balls could be pushed through and injected at one time. The atmosphere-to-pressure ball injection chamber would have to be large enough to accommodate the balls or configured to accommodate multiple balls.

Regarding the one or more first seal packs 70 and the one or more second seal packs 80, various seal pack designs and configurations can be substituted and still achieve the intended result. For example, at least the following seal packs or a combination of seal packs in a different location or even a combination of seal packs in the same location can be configured: Chevron Vee Pack Seal, Polypack Seal, Standard O-ring Seals, Quad Ring Seals, Rubber Seals, and Polyurethane Seals, and similar seal pack configurations, can be used and/or substituted. Generally though, the preferred seal packs are v-shaped o-ring type or similar.

Additionally, the atmosphere-to-pressure ball drop apparatus provides at least the following benefits: it allows for the dry un-pressurized storage of frac balls, which is particularly beneficial to dissolvable frac balls; it reduces or eliminates the need to heat a ball drop stack during inclement weather; and it reduces or eliminates the need for an increased height ball drop stack as two or more stacks can be configured in the same height footprint as one ball drop stack of the previous designs.

Although the concepts disclosed herein have been described in connection with the preferred form of practicing them and modifications thereto, those of ordinary skill in the art will understand that many other modifications can be made thereto. Accordingly, it is not intended that the scope of these concepts in any way be limited by the above description.

The invention claimed is:

1. A ball drop apparatus, the ball drop apparatus comprising:

one or more ball drop receiver sections connected to one or more atmosphere-to-pressure frac ball injection chambers, the ball drop receiver sections configured to feed one or more frac balls into the atmosphere-to-pressure frac ball injection chamber in an initial loading position, one or more first seal packs situated between the initial loading position of the one or more atmosphere-to-pressure frac ball injection chambers and one or more pressure equalization sections, one or more second seal packs situated between the one or more pressure equalization sections and an axial passageway connected to the wellbore, at least one of said one or more second seal packs comprising sealing elements interspersed with support rings, an injection ram assembly configured to move the one or more frac balls from the initial position of the one or more atmosphere-to-pressure frac ball injection chambers, through the one or more first seal packs and into the one or more pressure equalization sections and the one or more second seal packs, thereby releasing the one or more frac balls into the wellbore, and one or more pressure equalization apparatus connected to the one or more pressure equalization sections, the one or more pressure equalization apparatus configured to increase the pressure of the frac ball loaded atmosphere-to-pressure frac ball injection chamber situated in the pressure equalization section before the injection ram assembly moves the one or more frac balls into the wellbore.

2. The ball drop apparatus of claim 1, further configured such that the one or more pressure equalization apparatus connected to the one or more pressure equalization sections are configured to reduce the pressure of the atmosphere-to-pressure frac ball injection chamber as the injection ram assembly returns the atmosphere-to-pressure frac ball injection chamber to its initial loading position.

3. The ball drop apparatus of claim 1, further comprising:

one or more hydraulic assemblies connected to the injection ram assembly to facilitate movement of the injection ram assembly.

4. The ball drop apparatus of claim 1, further comprising:

one or more hydraulic pressure ports connected to one or more pairs of internal chambers of the injection ram assembly, the respective chambers configured to deploy or retract a sleeve that forms a tubular cavity around the frac ball injection chamber when deployed, the hydraulic pressure ports configured to move a piston contained within the internal chamber of the injection ram assembly which thereby causes the sleeve to move in respectively opposing directions dependent on which portion of the chamber is receiving greater hydraulic pressure.

5. The ball drop apparatus of claim 4, wherein the sleeve has one or more fluid passageways that provide a fluid passageway between an inner portion of the atmosphere-to-pressure frac ball injection chamber and an outer portion of the atmosphere-to-pressure frac ball injection chamber.

6. The ball drop apparatus of claim 1, wherein the one or more first seal packs are formed by a combination of two or more seal packs.

7. The ball drop apparatus of claim 1, wherein the one or more second seal packs are formed by a combination of two or more seal packs.

8. The ball drop apparatus of claim 1, wherein at least one of said one or more first seal packs comprises sealing elements interspersed with support rings.

9. The ball drop apparatus of claim 1, further comprising:

a main body with at least one end that is distal from the wellbore;

a portion of said main body adjacent to the distal end configured with outward facing threads; and a packing stop nut threadably engaged with said portion of said main body.

10. The ball drop apparatus of claim 9, further comprising a plate abutting said packing stop nut.

11. The ball drop apparatus of claim 1, wherein said support rings are formed of brass.

12. A ball drop apparatus, the ball drop apparatus comprising:

one or more ball drop receiver sections connected to one or more atmosphere-to-pressure frac ball injection chambers, the ball drop receiver sections configured to feed one or more frac balls into the atmosphere-to-pressure frac ball injection chamber, one or more first seal packs situated between the initial position of the atmosphere-to-pressure frac ball injection chambers and an axial passageway connected to the wellbore, at least one of said one or more first seal packs comprising sealing elements interspersed with support rings, an injection ram assembly configured to move the one or more frac balls from the initial position of the one or more atmosphere-to-pressure frac ball injection chambers, through the one or more first seal packs and into the one or more pressure equalization sections and the one or more second seal packs, thereby releasing the one or more frac balls into the wellbore, and one or more pressure equalization ports connected to the one or more pressure equalization sections, the one or more pressure equalization ports configured to relieve pressure to an onsite container from the atmosphere-to-pressure frac ball injection chamber situated in the pressure equalization section, after the injection ram assembly is withdrawn from wellbore pressure.

13. The ball drop apparatus of claim 12, further comprising:

one or more hydraulic assemblies connected to the injection ram assembly to facilitate movement of the injection ram assembly.

14. The ball drop apparatus of claim 12, further comprising:

one or more hydraulic pressure ports connecting to one or more pairs of internal chambers of the injection ram assembly, the respective chambers configured to deploy or retract a sleeve that forms a tubular cavity around the frac ball injection chamber when deployed, the hydraulic pressure ports configured to move a piston contained within the internal chamber of the injection ram assembly which thereby causes the sleeve to move in respectively opposing directions dependent on which portion of the chamber is receiving greater hydraulic pressure.

15. The ball drop apparatus of claim 14, wherein the sleeve has one or more fluid passageways that provide a fluid passageway between an inner portion of the atmosphere-to-pressure frac ball injection chamber and an outer portion of the atmosphere-to-pressure frac ball injection chamber.

16. The ball drop apparatus of claim 12, wherein the one or more first seal packs are formed by a combination of two or more seal packs.

17. The ball drop apparatus of claim 12, further comprising:

a main body with at least one end that is distal from the wellbore;

a portion of said main body adjacent to the distal end configured with outward facing threads; and a packing stop nut threadably engaged with said portion of said main body.

18. The ball drop apparatus of claim 17, further comprising a plate abutting said packing stop nut.

19. The ball drop apparatus of claim 12, wherein said support rings are formed of brass.

20. A method of injecting frac balls into a wellbore, the method comprising the following steps:

positioning an atmosphere-to-pressure ball injection chamber to receive a frac ball from a ball drop apparatus, inserting one or more frac balls into an atmosphere-to-pressure frac ball injection chamber from a ball drop apparatus, pushing, by an injection ram assembly, the atmosphere-to-pressure ball injection chamber and frac ball through a first seal pack comprising sealing elements interspersed with support rings and into a pressure equalization section, pressurizing the pressure equalization section with a pressure equalization apparatus until the pressure equalization section reaches wellbore or close to wellbore pressure, pushing, by an injection ram assembly, the atmosphere-to-pressure ball injection chamber and frac ball from the pressure equalization section through a second seal pack and into an axial passageway connected to the wellbore, thereby releasing the ball into the wellbore, retracting the atmosphere-to-pressure ball injection chamber into the pressure equalization section, and returning the pressure equalization section to atmospheric or close to atmospheric pressure by the pressure equalization apparatus.

21. The method of injecting frac balls into a wellbore of claim 20, wherein the pushing and retracting of the injection ram assembly is hydraulically driven.

22. The method of injecting frac balls into a wellbore of claim 20, further comprising the following steps:

pumping fluid through one or more internal chambers of the injection ram assembly, thereby deploying a sleeve around the frac ball injection chamber.

23. The method of injecting frac balls into a wellbore of claim 20, further comprising the following steps:

pumping fluid through one or more internal chambers of the injection ram assembly, thereby retracting a sleeve from the frac ball injection chamber.

24. The method of injecting frac balls into a wellbore of claim 20, wherein said second seal pack comprises sealing elements interspersed with support rings.

25. A method of injecting frac balls into a wellbore, the method comprising the following steps:

positioning an atmosphere-to-pressure ball injection chamber to receive a frac ball from a ball drop apparatus, inserting one or more frac balls into an atmosphere-to-pressure frac ball injection chamber from a ball drop apparatus, pushing, by an injection ram assembly, the atmosphere-to-pressure ball injection chamber and frac ball through a first seal pack comprising sealing elements interspersed with support rings, a pressure equalization section, a second seal pack, and into an axial passageway connected to the wellbore, thereby releasing the ball into the wellbore, and retracting the atmosphere-to-pressure ball injection chamber from the axial passageway connected to the wellbore.

26. The method of injecting frac balls into a wellbore of claim 25, wherein the retracting step further comprises:

bleeding pressure from a pressure equalization port to return the pressure of the ball injection chamber to at or near atmospheric pressure.

27. The method of injecting frac balls into a wellbore of claim 25, wherein the retracting step further comprises:

retracting the atmosphere-to-pressure ball injection chamber to an initial position where the chamber is configured to receive a frac ball from a ball drop apparatus.

28. The method of injecting frac balls into a wellbore of claim 25, wherein the pushing and retracting of the injection ram assembly is hydraulically driven.

29. The method of injecting frac balls into a wellbore of claim 25, wherein said second seal pack comprises sealing elements interspersed with support rings.

* * * * *